US005605418A

United States Patent [19]

Watanabe et al.

[11] Patent Number: 5,605,418

[45] Date of Patent: Feb. 25, 1997

[54] ROAD SNOW MELTING SYSTEM USING A SURFACE HEATING ELEMENT

[75] Inventors: Koji Watanabe, Akita; Yoshinori Nagai, Ichikawa, both of Japan

[73] Assignee: Taisei Home Engineering Kabushiki Kaisha, Japan

[21] Appl. No.: 123,044

[22] Filed: Sep. 20, 1993

Related U.S. Application Data

[63] Continuation of Ser. No. 886,597, May 21, 1992, abandoned.

[30] Foreign Application Priority Data

Feb. 28, 1992 [JP] Japan ..... 4-92476

[51] Int. Cl.[6] ..... E02D 19/14

[52] U.S. Cl. ..... 405/131; 219/528; 219/549; 392/435; 404/95; 405/258

[58] Field of Search ..... 405/131, 258; 37/227, 199; 404/71, 79, 95; 219/213, 528, 529, 544, 549, 548; 392/435

[56] References Cited

U.S. PATENT DOCUMENTS

| | | | |
|---|---|---|---|
| 2,851,992 | 9/1958 | Wolf | 392/435 X |
| 2,889,445 | 6/1959 | Wolf | 219/549 X |
| 2,952,001 | 9/1960 | Morey | 219/549 X |
| 3,236,991 | 2/1966 | Graham et al. | 404/71 X |
| 3,377,462 | 4/1968 | Pferschy | 404/71 X |
| 3,791,443 | 2/1974 | Burt et al. | 405/131 X |
| 3,859,504 | 1/1975 | Motokawa et al. | 219/549 X |
| 4,110,597 | 8/1978 | Elmore | 37/227 X |
| 4,141,187 | 2/1979 | Graves | 219/213 X |
| 4,305,681 | 12/1981 | Backlund | 405/131 X |
| 4,677,801 | 7/1987 | Bard | 219/213 X |
| 4,693,300 | 9/1987 | Adachi | 404/71 X |
| 4,919,744 | 4/1990 | Newman | 219/529 X |
| 4,937,435 | 6/1990 | Goss et al. | 219/528 |

FOREIGN PATENT DOCUMENTS

| | | |
|---|---|---|
| 704645 | 10/1967 | Belgium . |
| 1459745 | 12/1968 | Germany . |
| 534997 | 4/1973 | Switzerland . |
| 579859 | 9/1976 | Switzerland . |

*Primary Examiner*—Dennis L. Taylor
*Attorney, Agent, or Firm*—Nixon & Vanderhye P.C.

[57] ABSTRACT

The object of the present invention is to avoid the difficulty of recruiting snow removal personnel by automatically melting snow that has accumulated on roads in areas having cold climates, and protect human life and secure the safety of vehicles and aircraft traveling on such roads and runways.

The present invention is comprised of a heating unit wherein a surface heating element, in which an electrically conductive coating is applied onto a cloth, is positioned between metal plates such as aluminum plates above and below and wrapped in a tar-based moisture-proof sheet. Said heating unit is then embedded beneath the surface of road paving. After particularly carefully steam rolling the asphalt and concrete base layer in this case so that it is free of irregularities, the upper surface of said base layer is coated with a primer. After installing and wiring the above-mentioned heating unit on top of said primer-coated base layer, an additional coating of primer is applied followed by paving with a material having a high degree of thermal conductivity, such as an asphalt layer or concrete layer containing fine granules of blast furnace slag, to function as the surface material.

9 Claims, 2 Drawing Sheets

ROAD SNOW MELTING SYSTEM USING A SURFACE HEATING ELEMENT

This is a continuation of application Ser. No. 07/886,597, filed May 21, 1992, now abandoned.

BACKGROUND OF THE INVENTION

The present invention relates to an ice and snow melting structure which prevents accidents involving vehicles and aircraft traveling on roads or runways due to slipping caused by snow by removing said snow as a result of embedding a surface heating element beneath the surface of the ground to melt said snow.

Although there are numerous problems due to freezing and accumulation of snow on road surfaces in areas having cold climates, an example of one of those problems is the removal of snow from railroad crossings. The number of railroad crossings may be unexpectedly high, numbering as many as 60 within a single territorial jurisdiction in cities. Although more than 100 snow removal personnel are deployed for the removal of snow from these railroad crossings each time there is a significant snowfall, difficulties have recently been encountered in assembling enough personnel to perform this work.

At present, railroad crossings equipped with ice and snow melting equipment using heating systems powered by electric power have not come into common use. The reason for this is primarily based on apprehensions concerning problems with electrical connection systems caused by vibrations and so on when a train passes over the crossing, as well as the detrimental effects on the heating unit due to load pressure at the time heavily loaded freight cars or roadway vehicles pass over the crossing.

In addition, the use of these types of heating systems has also not proliferated in the case of removal of snow from runways at airports and removal of snow from ordinary roads due to problems similar to those described above being encountered.

Furthermore, although the shortcoming in terms of the strength of surface heating elements of the prior art was in the joint between the surface portion and the electrodes, Yoshinori Nagai, one of the inventors of the present invention, succeeded in improving on this shortcoming and applied for patent of such in the form of UM Application 1-146306 (Laid open No. 3-84584) dated Dec. 29, 1989.

SUMMARY OF THE INVENTION

The object of the present invention is to provide an ice and snow melting system, wherein the heating element is not damaged by the loads of vehicles traveling on roads or aircraft taking off and landing on runways, and which does not affect the service life of the road, etc.

In the present invention, a heating unit comprising a surface heating element is embedded beneath the surface of the ground.

The constitution of the heating unit which composes the surface heating element involves the surface heating element positioned between aluminum plates above and below, with the top and bottom of said heating element wrapped in a tar-based moisture-proof sheet that is adhered around it. Metal plates such as those of copper or iron may be used in place of aluminum, and different metal plates may be used for the upper and lower surfaces to prevent electrolytic corrosion.

The foundation for embedding the above-mentioned heating heating beneath the surface of the ground is first sufficiently steam rolled so that there are no irregularities in the asphalt beneath the ground as well as in the concrete base layer. Then, primer is applied, the heating unit is installed at the prescribed location and wiring connections are made.

When wiring work is completed, an additional coating of primer is applied to the upper surface of the heating unit. This is then covered with fine granular asphalt and concrete having a high degree of thermal conductivity as the surface material. A blend of fine granules of blast furnace slag used in iron manufacturing and asphalt is optimum for the asphalt used in the present invention.

As the surface heating element is comprised of cloth and coating, those factors which are cause for the greatest apprehension when embedding the heating element beneath the surface of the ground are whether or not said heating element will be able to withstand load pressure, as well as the risk of the crushed stones blended into the asphalt and concrete eating into the surface heating element. As such, in order to protect the surface heating element as well as to attach a ground wire, aluminum plates are installed above and below the surface heating element. Moreover, with respect to the action of the aluminum plates, the upper aluminum plate gradually transfers the heat radiated from the heating element to the tar-based moisture-proof sheet by temporarily accumulating said heat, and then transferring said heat to the highly thermal conductive fine granular asphalt that comprises the surface material in order to raise the temperature of the ground surface. On the other hand, the lower aluminum plate demonstrates effects which suppress the transfer of heat radiated from the heating element.

Thus, thermal efficiency is extremely favorable allowing a savings of roughly 40% less electrical power to maintain the surface temperature at a constant level than in the case of a heating element in which electric heating cords simply run through said heating element in zig-zag fashion. In addition, in contrast to the surface temperature one and a half hours after starting operation being −3.0 degrees Celsius in the case of a cord-type heating element, the surface temperature in the case of implementing the heating element of the present invention in the manner described above demonstrated a temperature of +0.6 degrees Celsius. In addition, in contrast to the surface temperature after 7 hours being +0.3 degrees Celsius in the case of a cord-type heating element, a temperature of +8.0 degrees Celsius was attained in the case of the present invention.

DESCRIPTION OF THE PREFERRED EMBODIMENT

The following provides an explanation of a preferred embodiment of the present invention using an example wherein the present invention is applied at a railroad crossing.

Figure 1:
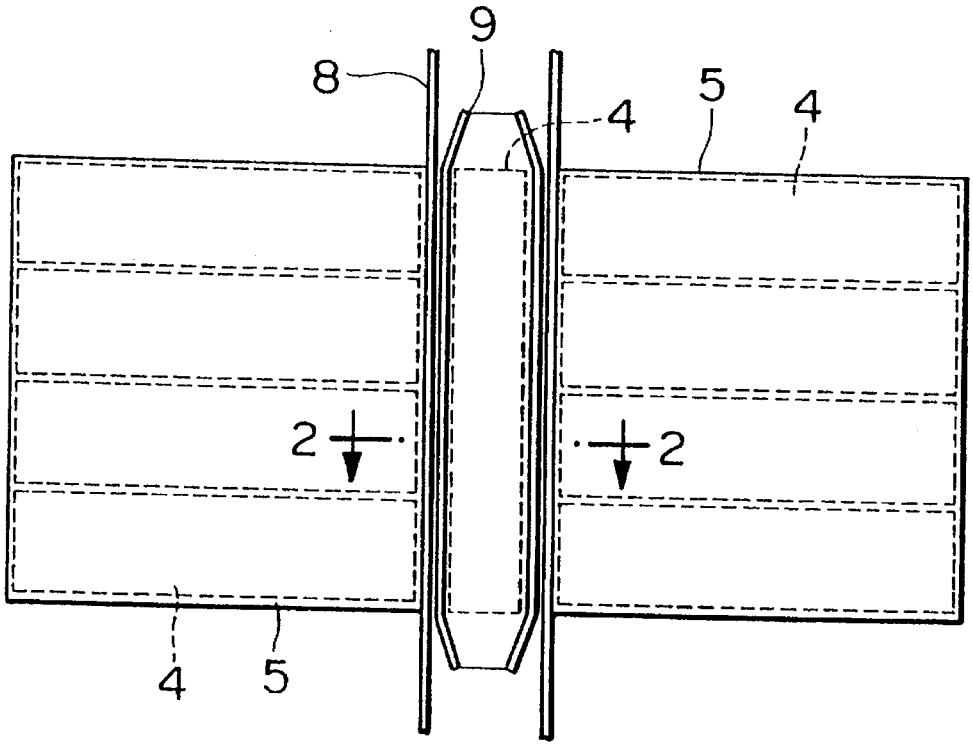
FIG. 1 is an overhead view of a railroad crossing at which a surface heating element is embedded.

FIG. 1 is a schematic drawing which indicates a portion of the cross-section of heating unit 4. The actual heating unit is a thin object free of any lamellar space. A surface heating element 1 of the heating unit 4 is comprised of an electrically conductive coating applied on both sides of cloth followed by lamination of a vinyl sheet. The surface heating element 1 is positioned between aluminum plates 2 which are adhered above and below the surface heating element. Moreover, tar-based moisture-proof sheet 3 is adhered around the outside of the plates 2 thus resulting in said heating unit 4 being sealed from the outside between cabtyre cables of the electrode wires.

Figure 2:
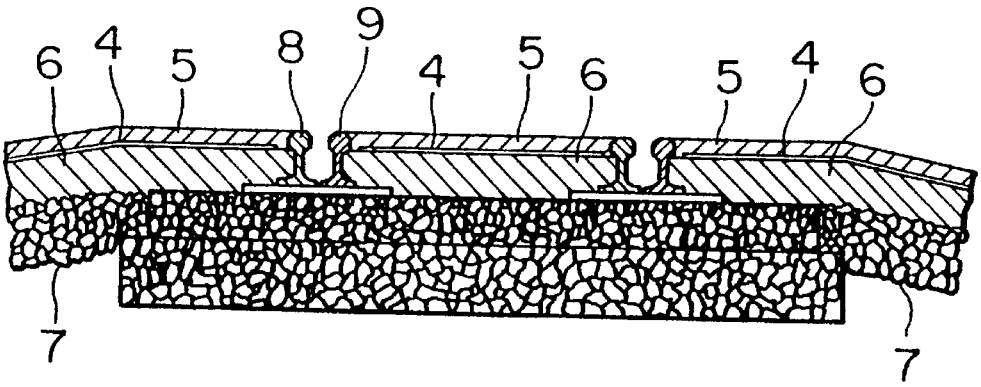
FIG. 2 is a side view of the cross-section taken along line A—A.
Figure 3:
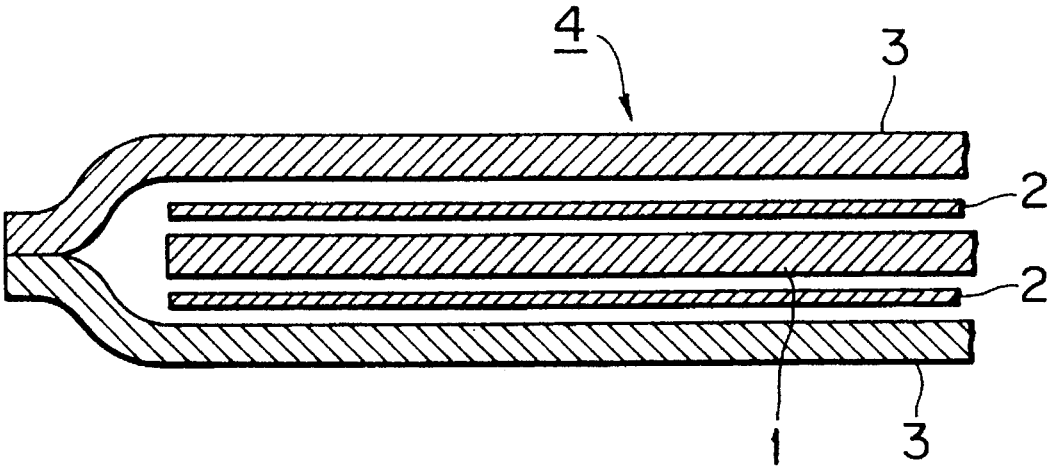
FIG. 3 is a schematic drawing indicating a portion of a cross-section of the heating unit.
Figure 4:
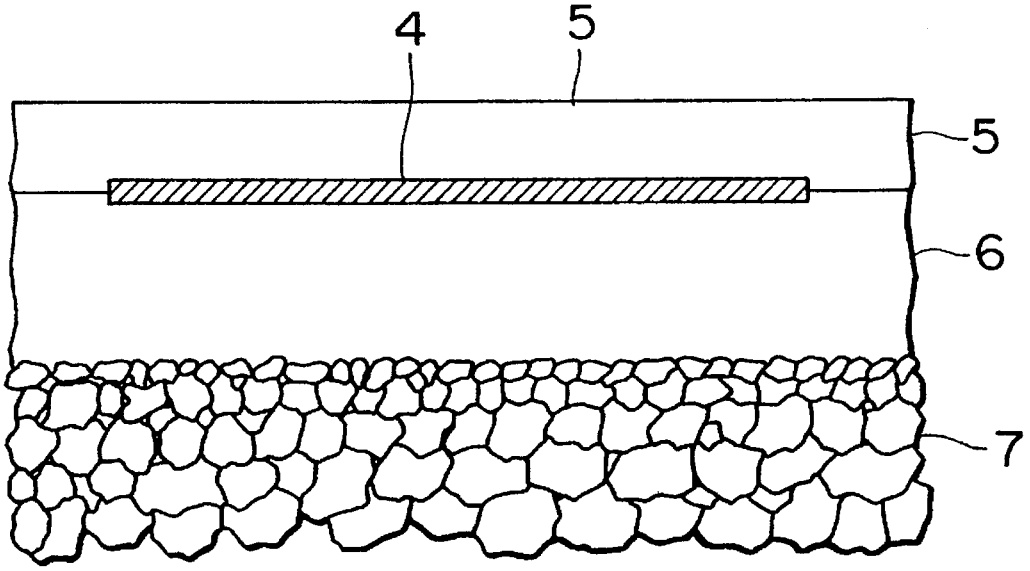
FIG. 4 is a cross-sectional side view of the foundation in which the heating unit is embedded.

FIG. 2 is a cross-sectional side view of the foundation in which heating unit 4 is embedded. Although cobblestone layer 7 is covered over the bottom using a procedure similar to routine construction procedures, the asphalt base 6 on top of said cobblestone layer 7 is steam rolled more carefully than in the case of routine construction procedures because it is critically important that the surface be flat and completely free of irregularities in comparison to routine construction procedures. Moreover, primer is coated onto said asphalt base 6 after which the heating unit 4 is installed at the prescribed location followed by wiring. Wiring work is performed in accordance with routine electrical wiring procedures, with wiring performed from said heating unit 4 to a control box using cabtyre cables and conduit. The control box is equipped with devices including an automatic operating unit activated by a snowfall sensor, and safety devices including a thermostat. The ground wire is taken off from aluminum plates 2. Following wiring work, an additional coating of primer is applied on the upper surface of heating unit 4 followed by the spreading of fine granular asphalt having a high degree of thermal conductivity to a thickness of 50–60 mm on top of said primer coating to function as surface material 5. Steam rolling, pressing and so on using a compactor or roller, etc. are then performed in accordance with conventional construction procedures.

With respect to the installation of the present invention, as the roadway portion is of a structure nearly identical to that of ordinary road paving, being comprised of asphalt and concrete without using foam heat insulating materials having a low level of strength, there is no reduction in the strength of the road paving. Consequently, although aluminum plates are used as heat insulating materials beneath the heating unit, the action of those plates as heat insulating materials is minimal. Instead, it was possible to obtain a higher degree of thermal efficiency in comparison to using foam heat insulating materials by using a material having a higher degree of thermal conductivity than ordinary paving material for the surface material. In addition, the present invention also offers the advantage of suffering fewer malfunctions as a result of the surface heating element being positioned between metal plates on both sides.

Thus, roadways and runways embedded with the surface heating element of the present invention are continuously kept free of snow and ice, thus nearly completely eliminating accidents caused by snow, including slipping and leaving of the roadway of vehicles crossing said roadways, thereby allowing the securing of safety and accuracy of drivers.

Moreover, it goes without saying that the present invention is not limited to use in only roadways and runways, but is also a system that can be widely applied in building roofs, athletic grounds and other locations at which removal of snow is required.

We claim:

1. A snow melting system for melting ice and snow on roads comprising a heating unit having an electrical surface heating element in sheet form positioned between a pair of adjacent metal plates and wrapped in a tar-based moisture-proof sheet, said heating unit embedded beneath a surface material of a paved road surface.

2. The snow melting system of claim 1 wherein said heating unit is embedded between a pair of rails of a railroad crossing as well as outside said pair of rails and beneath said surface material extending from said railroad crossing.

3. The snow melting system of claim 1 wherein said paved road surface comprises the runway of an airport.

4. The snow melting system described in any one of claims 1–3 wherein said paved road surface comprises a material having a high degree of thermal conductivity.

5. The snow melting system of claim 1 wherein said electrical surface heating element comprises a cloth with an electrically conductive coating applied to opposite sides thereof.

6. The snow melting system of claim 5 wherein a sheet is applied over said electrically conductive coating.

7. An ice and snow melting apparatus comprising a beating unit including an electrical surface heating element in sheet form, said heating element located between a pair of adjacent aluminum plates and sealed by a surrounding tar-based, moisture proof sheet, said heating unit adapted to be embedded in a paving surface electrically connected to a control unit.

8. The ice and snow melting apparatus of claim 7 wherein said electrical surface heating element comprises a cloth with an electrically conductive coating applied to opposite sides thereof.

9. The ice and snow melting system of claim 8 wherein a vinyl sheet is applied over said electrically conductive coating.

* * * * *